US005762168A

United States Patent [19]

Miyoshi

[11] Patent Number: 5,762,168

[45] Date of Patent: Jun. 9, 1998

[54] SUITCASE HAVING CASTERS

[75] Inventor: Etsuo Miyoshi, Okawa-gun, Japan

[73] Assignee: Swany Corporation, Kagawa, Japan

[21] Appl. No.: 625,288

[22] Filed: Apr. 1, 1996

[30] Foreign Application Priority Data

Oct. 12, 1995 [JP] Japan ..... 7-292128

[51] Int. Cl.[6] ..... A45C 5/14; A45C 13/26; A45C 13/36

[52] U.S. Cl. ..... 190/18 A; 190/39; 190/115; 280/37; 280/655

[58] Field of Search ..... 190/15.1, 18 A, 190/115, 117; 16/115; 280/37, 655

[56] References Cited

U.S. PATENT DOCUMENTS

| | | | |
|---|---|---|---|
| 2,805,077 | 9/1957 | Katz | 190/18 A X |
| 3,275,336 | 9/1966 | Warner, Jr. | 190/115 X |
| 3,522,955 | 8/1970 | Warner, Jr. | 190/18 A X |
| 3,606,372 | 9/1971 | Browning | 190/18 A X |
| 3,655,215 | 4/1972 | Becklin | 190/18 A X |
| 3,946,839 | 3/1976 | Butler | 190/18 A |
| 4,036,336 | 7/1977 | Burtley | 190/115 X |
| 4,261,447 | 4/1981 | Arias et al. | 190/18 A |
| 4,792,025 | 12/1988 | Thomas | 190/18 A |
| 4,995,487 | 2/1991 | Plath | 190/18 A |
| 5,307,908 | 5/1994 | Shyr et al. | 190/18 A |
| 5,414,895 | 5/1995 | Kazmark, Jr. | 16/115 |
| 5,547,052 | 8/1996 | Latshaw | 190/108 |

FOREIGN PATENT DOCUMENTS

| | | | |
|---|---|---|---|
| 187318 | 7/1986 | European Pat. Off. | 190/15.1 |
| 2661807 | 11/1991 | France | 190/18 A |
| 57-179824 | 11/1982 | Japan . | |
| 63-131634 | 8/1988 | Japan . | |
| 4-76686 | 12/1992 | Japan . | |
| 1 407 025 | 9/1975 | United Kingdom . | |
| 1409234 | 10/1975 | United Kingdom | 190/18 A |
| 2 278 319 | 11/1994 | United Kingdom . | |
| WO 92/19122 | 11/1992 | WIPO . | |

*Primary Examiner*—Sue A. Weaver
*Attorney, Agent, or Firm*—Wenderoth, Lind & Ponack

[57] ABSTRACT

A suitcase has four casters respectively fitted to the four corner portions of the suitcase body, and a handle capable of being stopped in an extended position where the handle is extended up from the suitcase body and a lowered position where the handle is pushed into the suitcase body. The casters are free casters which can freely run in all directions. The handle is provided at its upper end with a gripping part. The gripping part of the handle is disposed in the middle or substantially in the middle of the upper face of the suitcase, and is oriented in the longitudinal direction of the upper face of the suitcase body. When the handle is pushed down into the suitcase body, a gripping space is defined between the gripping part and the upper face of the suitcase body.

15 Claims, 10 Drawing Sheets

SUITCASE HAVING CASTERS

BACKGROUND OF THE INVENTION

The present invention relates to a suitcase having casters, and especially to a suitcase having casters and a vertically movable handle.

Different kinds of suitcases having casters and an extendable and retractable handle have been already developed and many are used. Many suitcases having such a structure can be carried onto an airplane. Suitcases having such a structure have been disclosed, for example, in the specifications of U.S. Pat. No. 4,995,487, Japanese Patent Publication No. 4-76686 issued Dec. 4,1992, and Japanese Non-examined Utility model Publications Nos. 57-179824 issued Nov. 15,1982 and 63-131634 issued Aug. 29, 1988. Each of the suitcases disclosed in the abovementioned specifications or publications is provided with two casters 1 on one side of the bottom face thereof as shown in FIG. 1. On the opposite side of the bottom face of the suitcase, two short leg studs 2 are fixed. When such a suitcase is put upright, the casters and the leg studs are in contact with the floor. In this state, since the non-rotative leg studs 2 are in contact with the floor, the suitcase stands upright and unmovable by itself. Further, the suitcase is provided with a handle 3 extendable from the upper end face thereof so that the user can walk while pulling the handle 3 of the suitcase. The handle 3 is provided on the same side of the upper end face with the casters 1, because the user pulls the suitcase in a tilted state.

As shown in FIG. 1, a suitcase of such structure can be moved by pulling the handle 3 of the suitcase in a tilted state. When the suitcase is in a tilted state, the casters 1 are in contact with the floor and the leg studs are out of contact with the floor. By pulling the handle 3 of the suitcase in this state, the casters can roll and the suitcase can be easily moved. However, casters 1 of such types of suitcases sometimes cannot be used in narrow or crowded places like the passenger cabin of an airplane. This is because the width of such type of suitcases while being moved running on the casters 1 is too large to freely pass through the narrow passage between seats of the passenger cabin of an airplane or other crowded places. When the casters 1 cannot be used, it is necessary to carry the suitcase by hand. The suitcase can be carried by hands in the direction indicated by the arrow A in FIG. 1 in order to reduce the lateral size of the suitcase.

A suitcase having casters is convenient because it is lightly and easily movable. Even if the suitcase is heavy, it can be easily moved by rolling the casters.

The inventor has developed a suitcase of a structure shown in FIG. 2 in order to eliminate the abovementioned disadvantage of the conventional suitcases.

In the suitcase according to the present invention as shown in FIG. 2, four casters 21 are fitted respectively to the four corners of the bottom face of the suitcase body 25. A handle 23 is mounted to the middle of the suitcase body, unlike the handle of the suitcase shown in FIG. 1, which is mounted to one side portion of the suitcase body. According to FIG. 2, a gripping part 23A of the handle 23 is located above the suitcase body 25 and in the middle thereof. Unlike the conventional suitcase shown in FIG. 1, the suitcase of the abovementioned structure is not moved in a tilted state. This suitcase is moved in an upright standing state in the direction indicated by the arrow shown in FIG. 2. When the suitcase is moved in the direction indicated by the arrow, the lateral size of the suitcase can be reduced. Therefore, the suitcase can be conveniently moved in an airplane or other crowded places. Further, by using free casters freely movable in all directions as the four casters 21, the suitcase can be moved in the desired directions in the upright standing state. The weight of the suitcase in the upright standing state is not applied to the handle 23. Therefore, if the suitcase is very heavy, it can be moved by only pushing the same. Further by providing a stopper for stopping the suitcase with the handle 23 in the extended position, the user can rest leaning on the suitcase, using it as a stick when tired.

The suitcase having casters 21 of the structure as shown in FIG. 2 is very conveniently usable as abovementioned. However, sometimes a suitcase cannot be moved by means of casters. For example, at places where there are grooves or stepped portions, the suitcase cannot be moved by means of casters. In such cases, it is necessary to lift and carry the suitcase by hand.

For lifting and carrying the suitcase by hand, the suitcase shown in FIG. 1 has a fixed handle 4 on the upper face thereof besides the extendable handle 3. The fixed handle 4 is fixed to the middle of the upper surface in order to carry the suitcase in a well balanced state. In the suitcase shown in FIG. 2, which was previously developed by the inventor, the upper part of the extendable handle, when retracted, is fitted into a groove provided in the upper face of the suitcase body in order not to interfere with the smooth carriage of the suitcase, and a fixed handle 24 is fixed to one side face of the suitcase body. When transporting the suitcase on the casters 21, the extendable handle 23 is raised as shown in FIG. 2, and when passing over a channel or a stepped place, the extendable handle 23 is pushed down and fitted into the groove provided on the upper face of the suitcase body and the user lifts and carries the suitcase while gripping the fixed handle 24 on the side face.

A suitcase used in such a manner is conveniently usable when transporting the same on the casters, but it is not conveniently usable when carrying the same by hand. This is because, for transporting the suitcase on the casters 21 and for carrying the same by hand, the posture of the suitcase must be changed from the lateral position to the longitudinal position, and the handle must by shifted from the extendable handle 23 to the fixed handle 24. The fixed handle 24 is only rarely used. The fixed handle 24 is temporarily used, and thereafter the suitcase is transported on the casters 21. Much time and labor is required to change the posture of the suitcase from the horizontal position to the vertical position or conversely for carrying the suitcase while gripping the fixed handle 24 and for transporting the same on the casters 21. Especially since a suitcase having casters is heavy, the posture of the same cannot be easily changed. Further, it is necessary to simply and easily shift the carrying of the suitcase while gripping the fixed handle 24 to transporting the same on the casters 21, because the user must temporarily lift and carry the suitcase while gripping the fixed handle 24 while transporting the suitcase on the casters 21.

The inventor has also provided a fixed handle 34 on the upper face of the suitcase body 35 as indicated with chain line in FIG. 3, so that the user can transport the suitcase by means of the casters 31 or by hand while gripping the fixed handle 34 without changing the posture of the suitcase. In this suitcase, the fixed handle 34 is fixed to the side portion of the upper face of the suitcase body 35, since the extendable handle 33 is provided at the center of the upper face. It is very important to provide the extendable handle 33 in the middle of the upper face of the suitcase body 35 in order to provide well-balanced transport of the thin and high suitcase in the upright standing state, and further in order to keep the suitcase stable even when the user takes a rest by leaning on the suitcase as a support.

The user can lift and carry a suitcase having a fixed handle 34 at the position indicated by the chain line in FIG. 3 with gripping the fixed handle 34. It is not necessary to shift the posture of the suitcase provided with a fixed handle 34 in the center of the upper face, as indicated with the chain line in FIG. 3, from the vertical position to the horizontal position or conversely transport the same by means of casters or by gripping the fixed handle. However, a suitcase having such a structure is disadvantageous in that the suitcase is apt to be inclined when lifted by gripping the fixed handle 34. The inclined suitcase touches the user's body and cannot be easily carried. Especially when a heavy suitcase is inclined, it is difficult to carry the same.

SUMMARY OF THE INVENTION

The present invention has been developed in order to further eliminate the above disadvantages and an object of the present invention is to provide a suitcase having casters which is of a simple structure, easily transportable on the casters, able to be easily lifted and carried by hand, and transportable with a rapid shift from carrying the same by hand to transporting the same on the casters or conversely.

A suitcase having casters according to the present invention comprises a suitcase body capable of being opened and closed, four casters fitted to four corner portions of a bottom face of the suitcase body, an upwardly extendable handle mounted to the suitcase body, and a stopper which stops the extendable handle at a position extended from the suitcase body and at another position retracted in to the suitcase body.

The casters are free casters capable of freely running in all directions. The handle has a gripping part at the upper end thereof, and is mounted to the suitcase body in such a manner that the gripping part is located in the middle or substantially in the middle of the upper face of the suitcase body and directed in the longitudinal direction of the upper face of the suitcase body.

Further, a gripping space is defined between the gripping part and the upper face of the suitcase body when the handle is retracted to the suitcase body and stopped by means of the stopper. Further, the stopper is preferably so constructed as to stop the handle at a position to provide the gripping space between the gripping part and the upper face of the suitcase body when the handle is retracted into the suitcase body.

A suitcase having casters according to the present invention is advantageous in that, though being of an extremely simple structure, it can be easily transported on the casters, and when the casters are not usable, the handle is pushed into the suitcase and locked and then the suitcase can be lifted and carried by gripping the gripping part of the handle. A suitcase having casters according to the present invention is advantageous in that the user can simply, easily and rapidly shift from transporting the suitcase on the casters to lifting and carrying the same by gripping the gripping part or conversely. By extending the handle up from the suitcase body, the user can transport the suitcase on the casters, while by pushing down and retracting the handle into the suitcase body, the user can lift and carry the suitcase by gripping the gripping part of the handle. As a result, a suitcase according to the present invention is advantageous in that, unlike the conventional suitcases having casters, it is neither necessary to change the posture of the suitcase from the lateral position to the longitudinal position or conversely, nor change the handle to grip to the other handle provided at a different position of the suitcase body for shifting transport of the suitcase on the casters to lifting and carrying the same by gripping the gripping part or conversely, and also in that the user can carry the suitcase in a stable upright state by gripping the gripping part of the retracted handle.

Further, a suitcase having casters according to the present invention is advantageous in that, though being conveniently usable as mentioned above, the suitcase requires only a handle of an extremely simple structure, because the same handle used for transporting the suitcase on the casters can also be used for lifting and carrying the suitcase by hand, and therefore, the suitcase can be mass-produced at a low cost. Furthermore, in a suitcase according to the invention, a gripping space is defined between the gripping part of the retracted handle and the upper face of the suitcase body, and the same handle used for transporting the suitcase on the casters can also be used for lifting and carrying the suitcase by hand, and therefore the handle does not require especially complicated structure.

BRIEF DESCRIPTION OF THE DRAWINGS

The above and further objects and features of the present invention will more fully be apparent from the following detailed description given with accompanying drawings, in which.

DETAILED DESCRIPTION OF THE INVENTION

Figure 1:
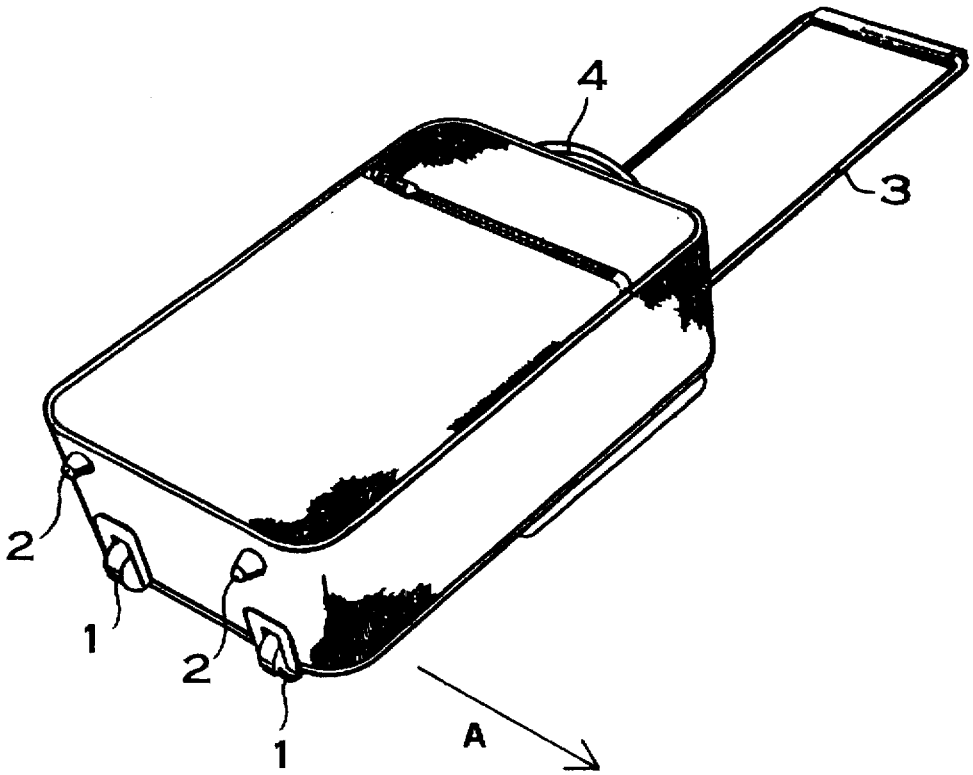
FIG. 1 PRIOR ART
FIG. 1 is a perspective view showing a conventional suitcase having casters.
Figure 2:
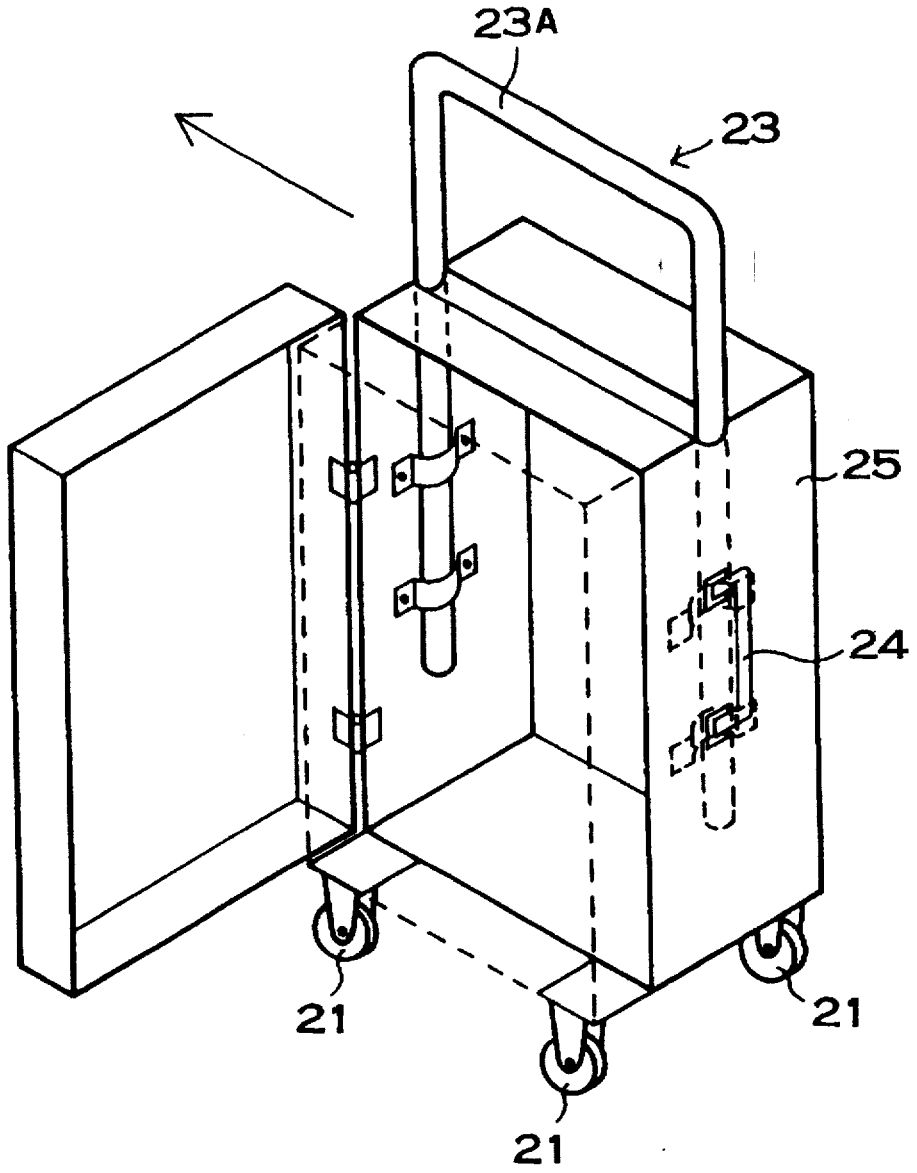
FIG. 2 PRIOR ART
FIG. 2 is perspective view showing a suitcase having casters which is a prior art invented by the inventor.
Figure 3:
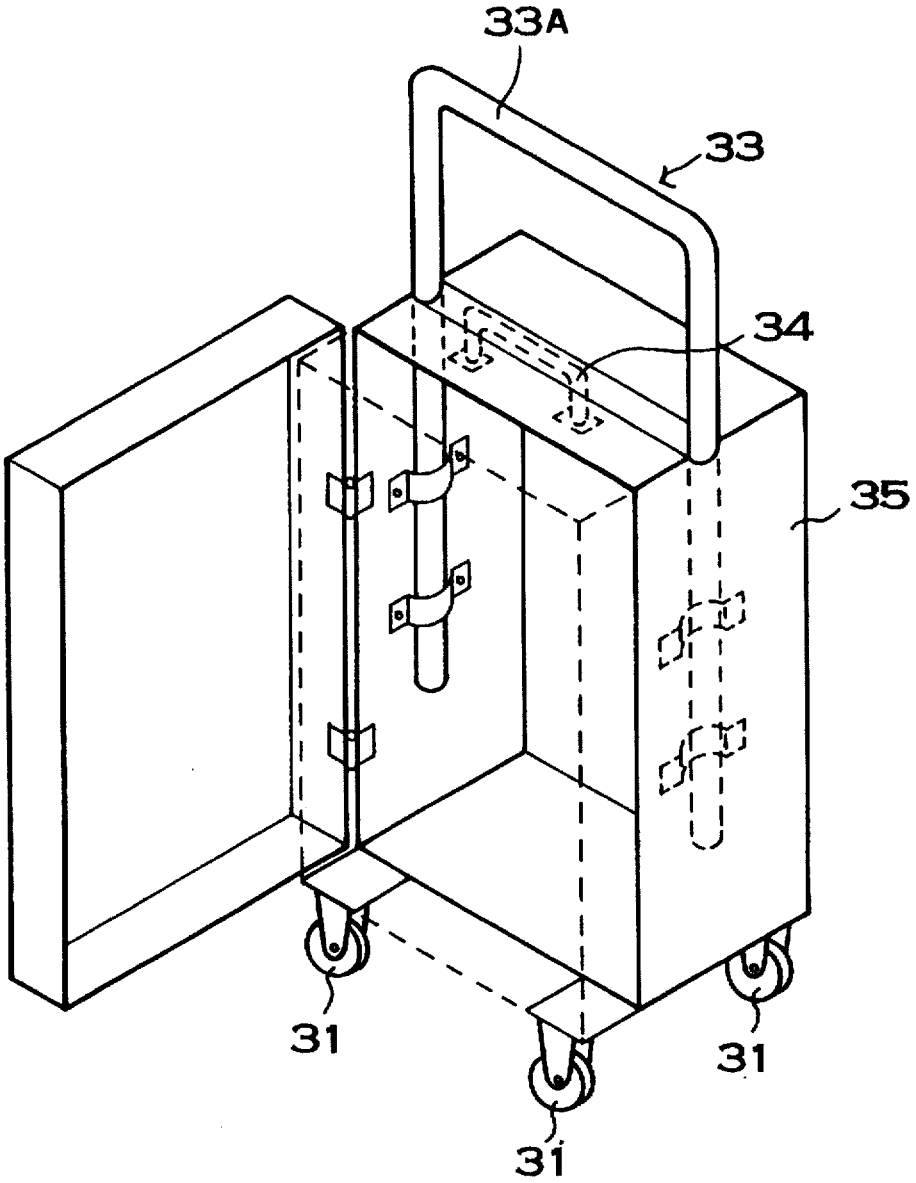
FIG. 3 PRIOR ART
FIG. 3 is a perspective view showing a suitcase having casters which is other prior art invented by the inventor.
Figure 4:
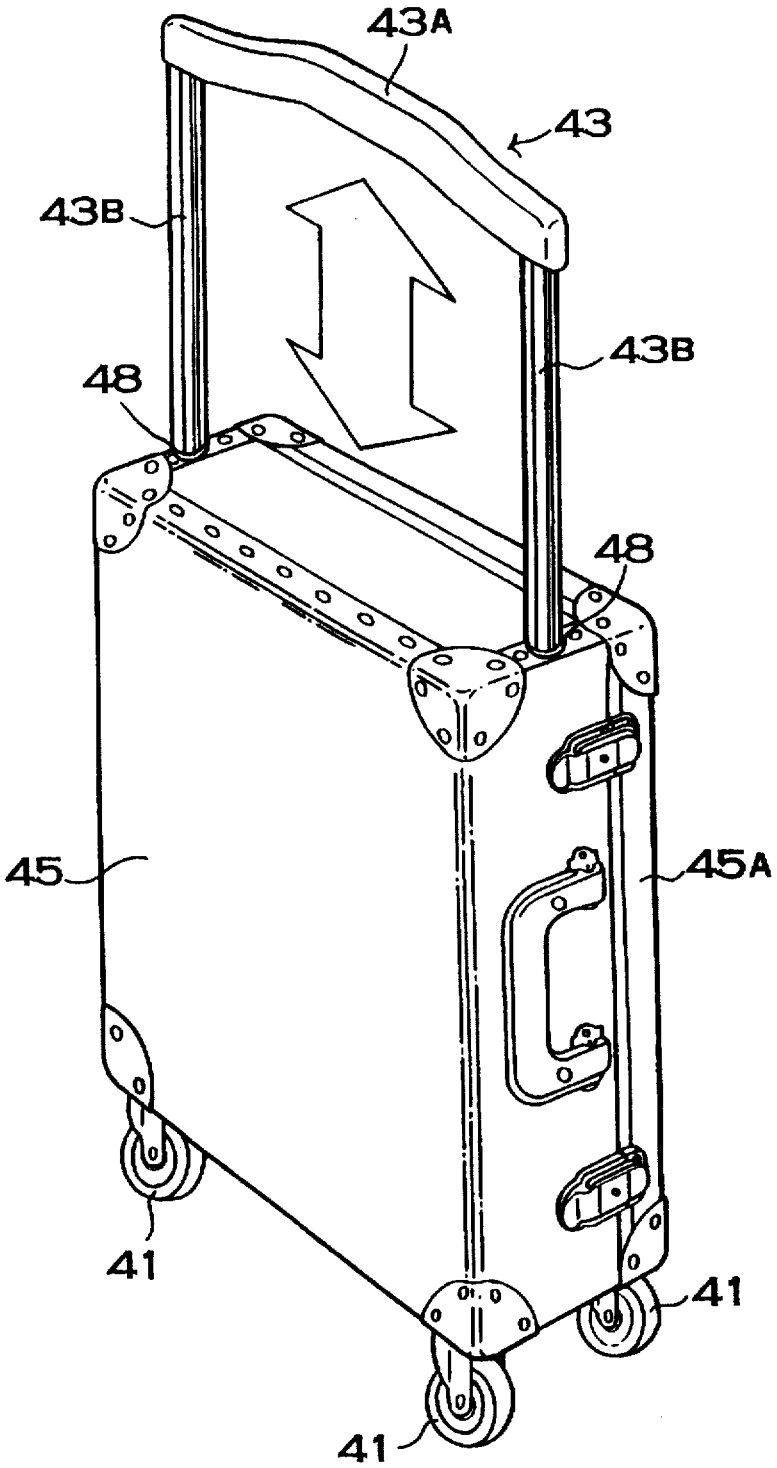
FIG. 4 is a perspective view showing an embodiment of a suitcase having casters according to the present invention.

In a suitcase having casters shown in FIG. 4, caster attachment means are fixed to the bottom face of the suitcase body 45 and casters 41 are fixed respectively to the caster attachment means. Further, a vertically extendable handle 43 is mounted to the suitcase body 45.

A lid part 45A is connected through hinges (not shown) to the suitcase body 45. The suitcase body 45 and the lid part 45A are molded or formed of a rigid material having a sufficient strength, for example, plate members molded of fibrous material hardened and combined with a binder, waterproof rigid paper coated on the surfaces with paint, a rigid plastic material, or metals such as aluminium. The suitcase body 45 and the lid part 45A are designed to have a thickness such as to provide strength sufficient to prevent deformation of the suitcase body 45 and the lid part 45A even with pretty heavy contents.

There are two types of suitcase. One type of suitcases is to be carried into a commercial aircraft, and the other type is a large-sized travelling suitcase. The dimensions of the suitcases to be carried into a commercial aircraft are to be selected smaller than the largest dimensions of the suitcases carriable into the commercial aircraft. Now, the largest dimensions of the suitcases carriable into a commercial aircraft are decided to be smaller than 50×35×20 cm. Therefore, the whole outer dimensions of the suitcase carriable into the commercial aircraft are selected smaller than 50×35×20 cm. Further, preferably a suitcase carriable into a commercial aircraft is more than 10 cm in thickness and 20 cm in width, so that the suitcase can be transported on the casters in the upright standing state with pretty heavy contents. Preferably, the bottom face sizes of a suitcase are selected to be more than 10×20 cm so that it can be stably transported in the upright standing state. The sizes of a large-sized suitcase carriable into a commercial aircraft into which a number of articles are contained are selected to be 20 cm in thickness and 35 cm in width. The sizes of a rather compact suitcase are selected to be 15 cm in thickness and 25 cm to 30 cm in width. The whole height of a suitcase carriable into a commercial aircraft including the height of a caster 41 is selected to be less than 50 cm. The height of the suitcase body and the lid part of a compact suitcase is selected to be 30 cm to 35 cm. The dimensions of a large-sized travelling suitcase, not being carried into a commercial aircraft, are 20 cm to 40 cm in thickness of the bottom face, 1.5 to 3 times the thickness in the width of the bottom face and 40 cm to 60 cm in height.

Figure 5:
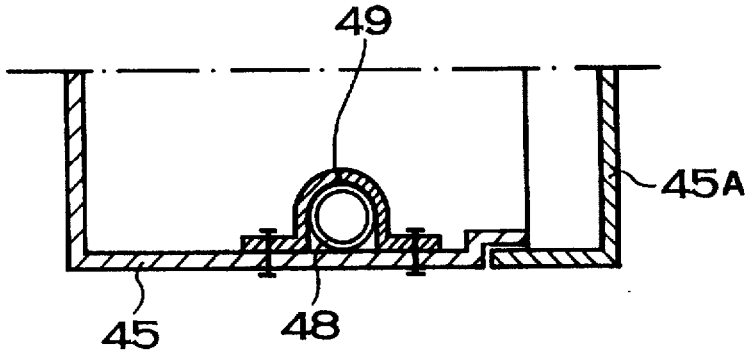
FIG. 5 is a sectional view showing a part for fixing a vertical support to the suitcase according to the present invention of FIG. 4.

The handle 43 comprises two vertical rods 43B and a horizontal gripping part 43A connected to the upper ends of the two vertical rods 43B, and the handle 43 as a whole is U-shaped. The two vertical rods 43B are mounted through two cylindrical guide means 48 to the suitcase body 45 so as to be vertically extendable from and retractable into the suitcase body 45. The cylindrical guide means 48 are vertically fixed onto the inner surface of the suitcase body 45. The vertical rods 43B can be slidable in the cylidrical guide means 48. The cylindrical guide means 48 are vertically fixed to the center of the inner surface of the narrow side face of the suitcase body 45 so that the vertical rods 43B can be disposed at the center of the upper face of the suitcase body 45. The cylindrical guide means 48 are fixed onto the inner surface of the suitcase body by means of saddle members 49 or with adhesive agent as shown in the sectional view of FIG. 5. The saddle members 49 are fixed to the inner surface of the suitcase body 45 by means of rivets or with adhesive agent.

Figure 6:
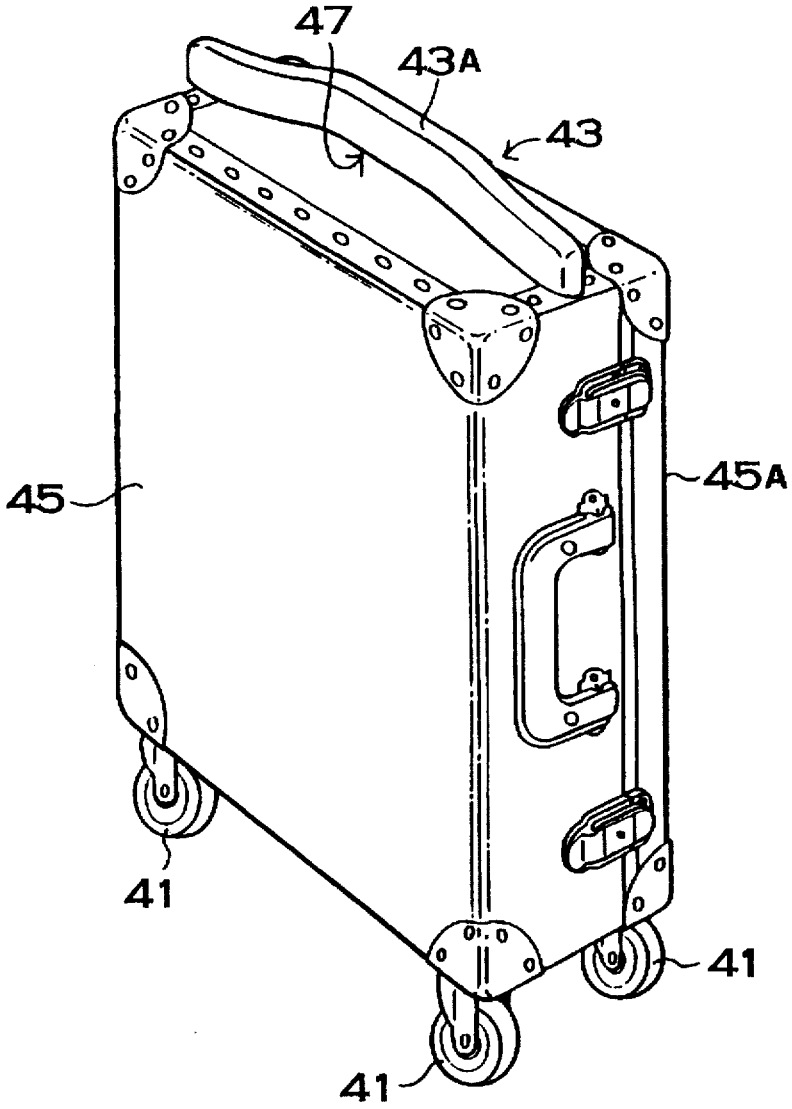
FIG. 6 is a perspective view showing the suitcase of FIG. 4 with the handle in the retracted position.

For transporting the suitcase on the casters 41, the handle 43 is pulled upwardly and extended. When the suitcase is not transported on the casters 41, the handle is pushed down into the suitcase body 45. As shown in FIG. 6, when the handle is pushed down into the suitcase body 45, a gripping space 47 is defined between the gripping part 43A and the upper face of the suitcase body 45.

The middle portion of the gripping part 43A of the handle 43 shown in FIG. 6 is curved upwardly, and the gripping space 47 is defined between the gripping part 43A and the upper face of the suitcase body 45 when the handle 43 is pushed down into the suitcase body 45. With a handle 43 of such structure, a gripping space 47 can be defined by putting both ends of the gripping part 43A in contact with the upper surface of the suitcase body 45 as shown in FIG. 6 or by putting both ends of the gripping part into a groove provided in the upper surface of the suitcase body 45 (not shown).

The handle 43 is stopped by a stopper at the extended position and the lowered position. The handle is stopped at the extended position when the user transports the suitcase on the casters 41 by pushing the handle 43A, and when the user takes a rest by leaning on the gripping part 43A of the suitcase as if leaning on a stick. In such states of use, the handle 43 is being stopped by means of a stopper in order to prevent the handle from being pushed down into the suitcase body 45. On the other hand, the handle 43 is pushed down and stopped at the lowered position for lifting and carrying the suitcase with gripping the gripping part 43A of the handle 43.

Figure 7:
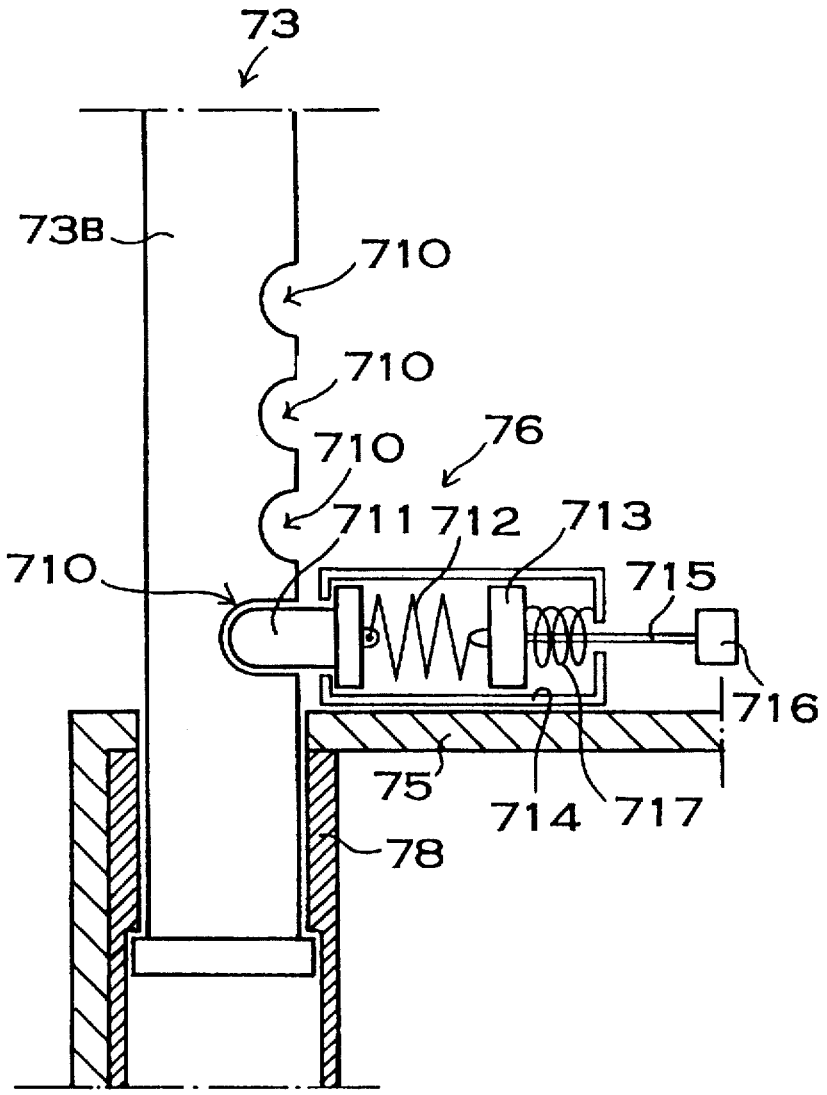
FIG. 7 is a sectional view showing an embodiment of a stopper of a suitcase according to the present invention

A stopper for stopping the handle at the predetermined positions is shown in FIG. 7. The stopper 76 of FIG. 7 locks the vertical rod member 73B by resiliently pushing an engagement pin 711 provided on the suitcase body 75 into a recess 710 provided in the inside surface of the vertical rod member 73B. The engagement pin 711 is connected through a spring 712 to a piston 713. The piston 713 is contained in a cylinder 714 so as to be able to make a reciprocating movement in the cylinder. Further, a rod 715 is connected to the piston 713 and a knob 716 is connected to the rear end of the rod. A coil spring 717 is contained behind the piston 713 in the cylinder 714. The spring force of the coil spring 717 is stronger than that of the spring 712 for reciprocating the engagement pin 711.

In the upper and lower end portions of the vertical rod member 73B, recesses 710 are provided into which the head portion of the engagement pin 711 is to be inserted. Only one recess may be provided in each of the upper and the lower portions of the vertical rod member 73B, or a plural number of recesses may be provided with a predetermined space therebetween in the upper and lower portions of the vertical rod member 73B. In FIG. 7, a plural number of recesses 710 are provided in the lower portion of the vertical rod member 73B, and the lowest recess is deep. In the handle 73 of such structure, when the engagement pin 711 is inserted into the lowest recess 710, the vertical rod member 73B cannot be lowered down as long as the engagement pin 711 is not pulled back. The recesses 710 higher than the lowest one are formed shallow so that by strongly pushing down the vertical rod member 73B, the engagement pin 711 is pushed out of the recess and retracted. In the handle 73 of this structure, when the vertical rod member 73B is pulled up from the cylindrical guide means 78, the engagement pin 711 is inserted in a recess 710 and stopped at a predetermined position.

When the handle 73 is pulled up to the uppermost position, the engagement pin 711 is inserted into the lowest recess 710 and the handle is not lowered even if it is pushed downwardly. In order to lower the handle 73, the engagement pin 711 is compulsorily retracted through piston 713 and the spring 712 by pulling back the knob 716 connected to the rear end of the rod 715. When the engagement pin 711 is retracted, out of the recess 710, the vertical rod member 73B is disengaged. Therefore, by pulling the knob 716 of the rod 715, the handle 73 can be pushed down and contained in the suitcase.

The whole length of the vertical rod member 73B is so designed that with the handle 73 being the uppermost position, the length from the lower end of the caster to the gripping part is about 80 cm. However, the length from the lower end of the caster to the gripping part may change within the range from 60 cm to 100 cm. When the gripping part is about 80 cm high, the user can most easily can transport the suitcase on the casters by pushing the gripping part 73A. The gripping part connected to both of the upper ends of the vertical rod members is extends in the longitudinal direction of the upper face of the suitcase. The gripping part is kept horizontal by the same lengths of the two vertical rod members 73B being extended up from the suitcase.

In the handle 43 of the suitcase shown in FIG. 4, both ends of the gripping part 43A are connected to the two vertical rod members 43B respectively. The handle 43 of such structure is firmly connected through the two vertical rod members 43B to the suitcase. However, the present invention is not limited to a suitcase in which the handle 43 is connected through two vertical rod members 43B to the suitcase body 45 as shown in FIG. 4. Though not shown, the gripping part of the handle can be connected through only one vertical rod member to the suitcase body. Such a gripping part is connected through a non-rotative vertical rod member to the suitcase body. For non-rotatively connecting the vertical rod member to the suitcase body and non-rotatively extending and retracting the vertical rod from and to the suitcase body, the vertical rod member has a square pillar shape, and the cylindrical guide means comprises a square pipe into which the vertical rod member can be inserted. The gripping part connected to the non-rotative vertical rod member is so fixed as to be extended in the longitudinal direction of the upper face of the suitcase above the middle portion of the upper face of the suitcase.

Figure 8:
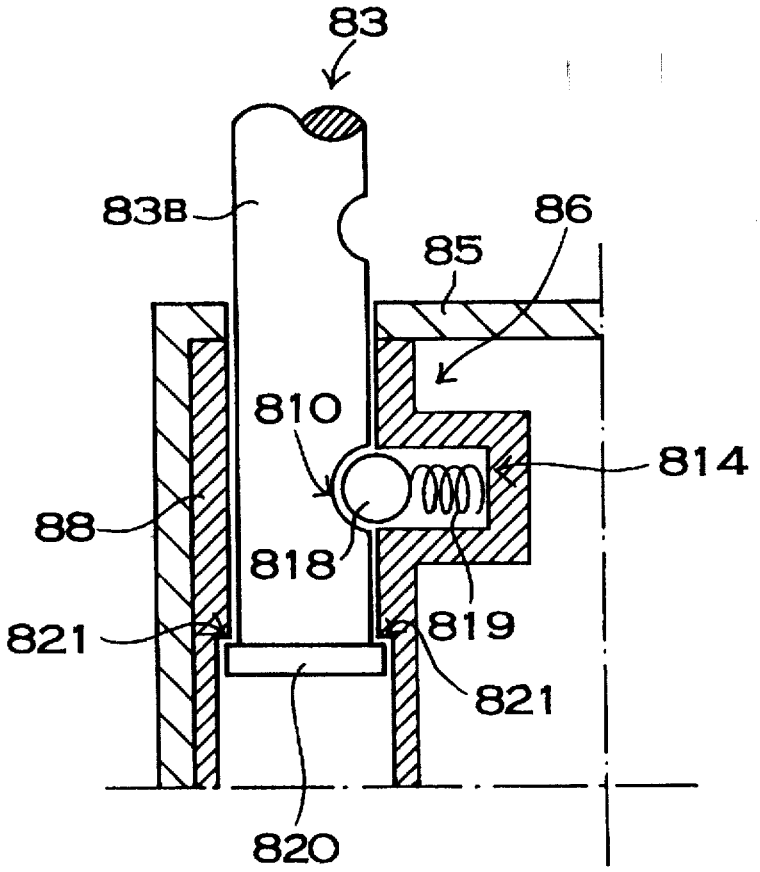
FIG. 8 is a sectional view showing another embodiment of a stopper of a suitcase according to the present invention.

FIG. 8 shows a stopper 86 of another structure for stopping a vertical rod member 83B at a predetermined position. The stopper 86 shown in this figure resiliently pushes a ball 818 into a recess 810 provided in the inside surface of the vertical rod member 83B. For resiliently pushing the ball 818, a coil spring 819 is contained between the ball 818 and a cylinder 814. The coil spring resiliently pushes the ball 818. A flange 820 is fixed at the lower end of the vertical rod member 83B so that the vertical rod member 83B is not pulled away from the cylindrical guide means 88. At the upper end of the cylindrical guide means 88, a stepped portion 821 is provided for engaging with the flange 820. The stopper 86 of such structure functions as follows. When the handle is extended from suitcase body 85 and the vertical rod member 83B is raised from the cylindrical guide means 88, the ball 818 is fitted into the recess 810 and thereby the vertical rod member 83B is stopped in the extended position. Further, when the handle is pushed down into the suitcase body 85, the ball 818 is fitted into the recess 810 provided in the vertical rod member 83B, the vertical rod member 83B is stopped in the lowered position. When the handle is stopped in the lowered position, a gripping space is defined between the gripping part and the upper face of the suitcase body 85. The user inserts his hand into the gripping space and grips the gripping part, and lifts and carries the suitcase.

Figure 9:
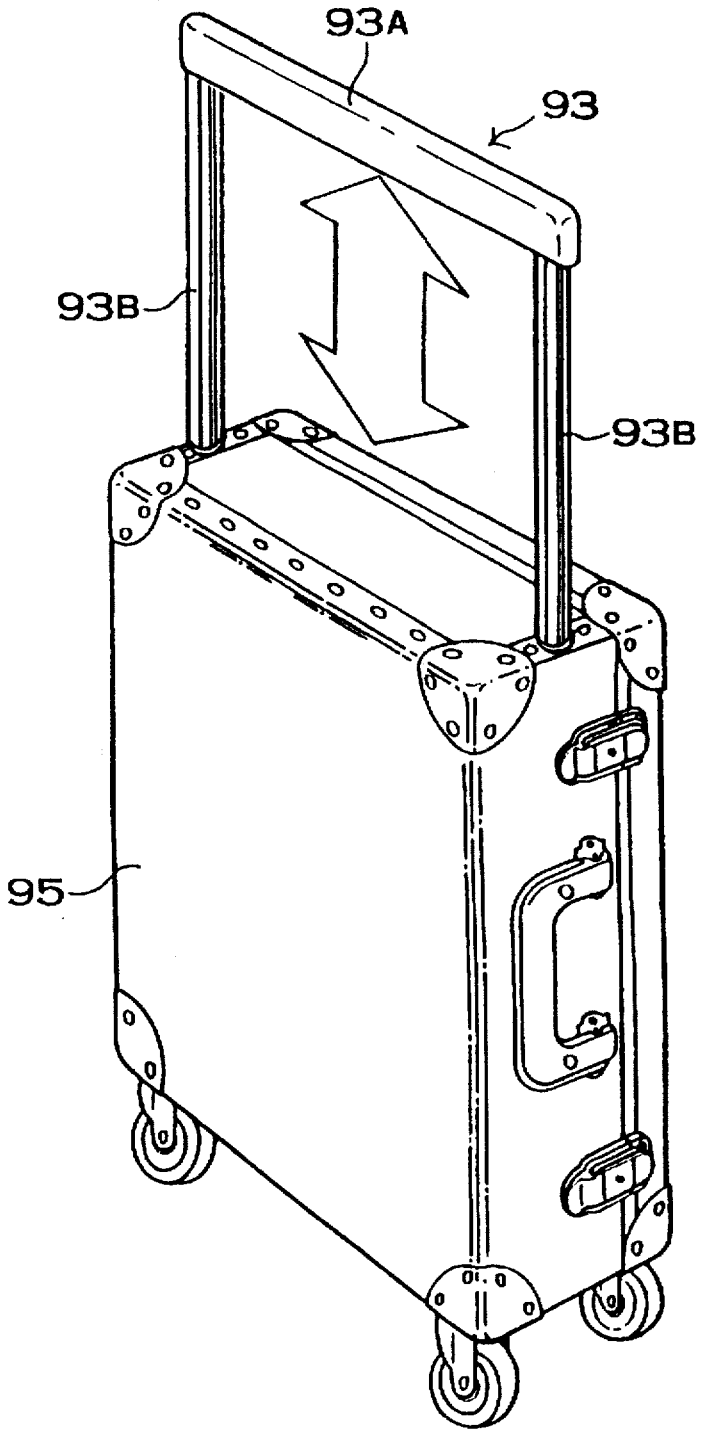
FIG. 9 is a perspective view showing another embodiment of a suitcase according to the present invention.
Figure 10:
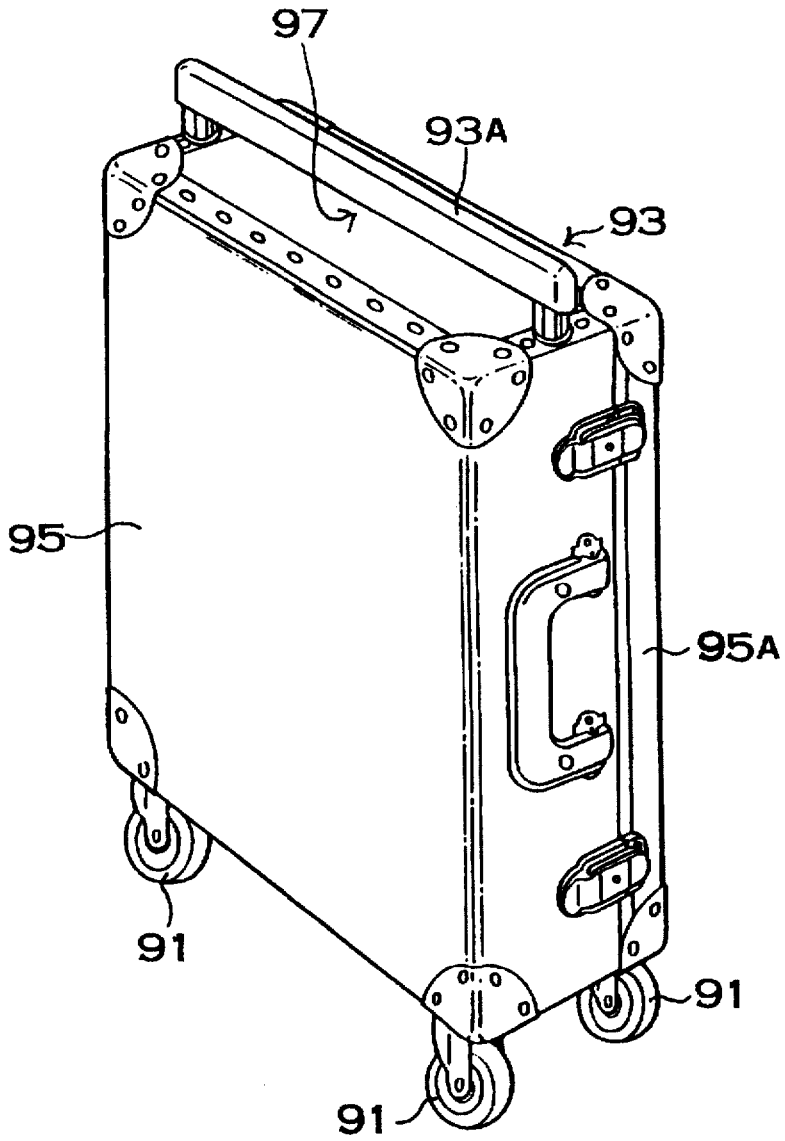
FIG. 10 is a perspective view of the suitcase of FIG. 9 with the handle in the retracted position.

In the suitcases shown in FIGS. 4 and 6, the gripping part 43A is curved into an angle, and thereby provides the gripping space 47 between the lowered gripping part 43A and the upper face of the suitcase body. However, the present invention is not limited to a suitcase having such a shape of the gripping part. The gripping part may have a linear shape as shown in FIG. 9. In a, suitcase having a linear gripping part, a gripping space 97 is defined between the gripping part 93A of the handle 93 in the lowered position and the upper face of the suitcase body 95 as shown in FIG. 10. Therefore, a stopper stops the handle 93 so that the gripping space 97 can be defined between the gripping part 93A of the handle in the lowered position and the upper face of the suitcase body 95. As a stopper for stopping the vertical rod member 93B at such a position, the stoppers shown in FIGS. 7 and 8 can be used. Further, in a suitcase according to the present invention, any mechanism capable of stopping the handle at a predetermined position can be used as the stopper.

Figure 11:
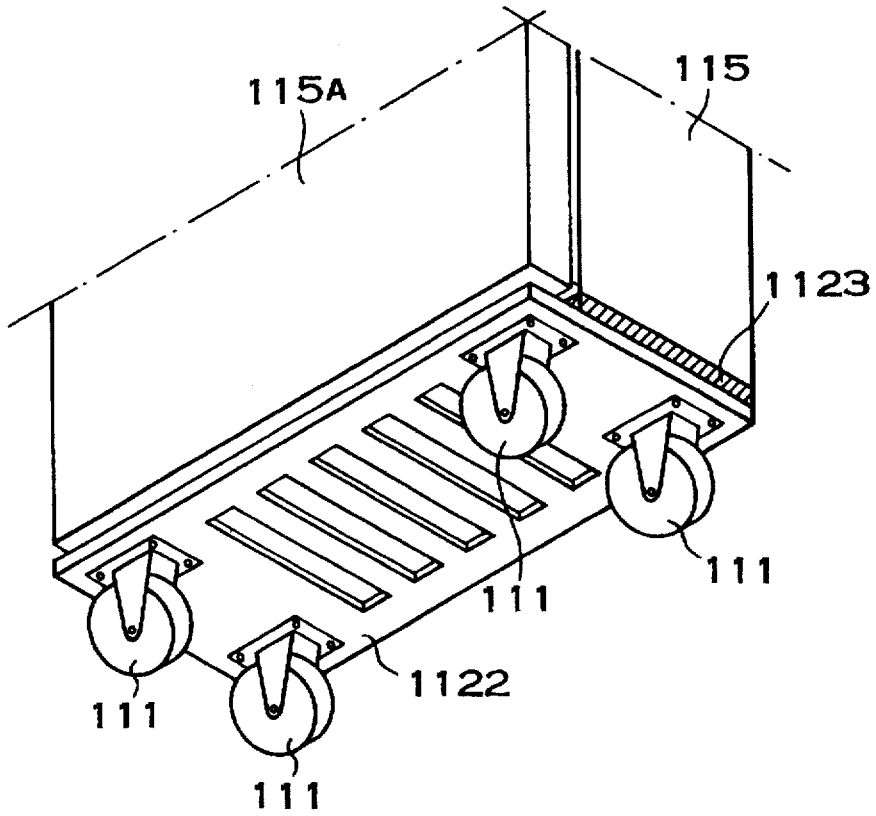
FIG. 11 is a perspective view showing the bottom face of the suitcase.
Figure 12:
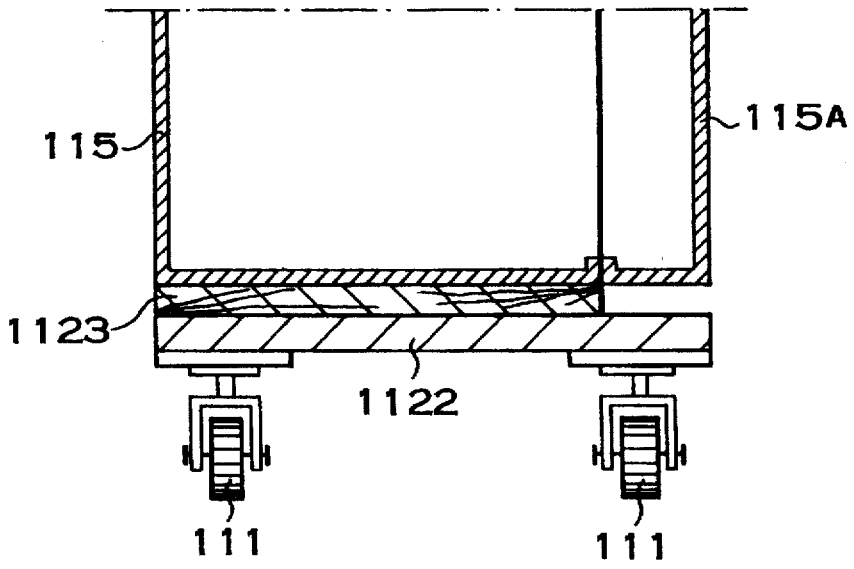
FIG. 12 is a sectional view showing a part fixing the casters to the suitcase.

Further, in a suitcase having casters, casters 111 are fixed to the four corners of the bottom face of a suitcase body 115 as shown in FIGS. 11 and 12. The casters 111 are fixed to a caster attachment plate 1122. The caster attachment plate 1122 is fixed through a reinforcing and space providing plate 1123 to the suitcase body 115. The reinforcing and space-providing plate 1123 may comprise, for example, plywood. The reinforcing and space-providing plate 1123 reinforces the bottom face of the suitcase body 115 and fixes the caster attachment plate 1122 to the suitcase body 115, and at the same time provides a space between the lid part 115A and the caster attachment plate 1122.

The caster attachment plate 1122 has a size such that it extends from the bottom face the suitcase body 115 to the lower face of the lid part 115A. The caster attachment plate 1122 is fixed through screws or rivets to the suitcase body 115 or to the reinforcing and space-providing plate 1123. When the caster attachment plate 1122 is fixed to the suitcase body 115, it is fixed through the reinforcing and space-providing plate placed therebetween. Further, the caster attachment plate 1122 may be fixed to the reinforcing and space-providing plate 1123 by an adhesive agent. The caster attachment plate 1122 is formed of a metal plate such as an aluminium plate so as to have a sufficient strength. A caster attachment plate 1122 formed of an aluminium plate is preferably 2 mm to 5 mm thick and more preferably 3 mm to 4 mm thick. The caster attachment plate 1122 shown in FIG. 11 has penetration openings in a central part for reducing the weight. Further, though not shown, the caster attachment plate may be divided into two. The two caster attachment plates may be fixed to both sides of the bottom face of the suitcase body, and the caster attachment plates may be extended from the bottom face of the suitcase body to a position below the bottom face of the lid part.

The casters 111 are fixed to the caster attachment plate 1122 at the four corners of the bottom face of the suitcase. The caster 111 comprises a so-called a free caster which can freely rotate in all directions. However, all the casters need not be free casters, but two casters provided on one side of the suitcase body 115 may be free casters with the remaining two being not free casters. The casters 111 are fixed through screws or rivets to the lower face of the caster attachment plate 1122.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within the metes and bounds of the claims, or equivalents of such metes and bounds thereof are therefore intended to be embraced by the claims.

What is claimed is:

1. A suitcase comprising:

a suitcase body having a bottom comprising four corners, an upper surface having a longitudinal direction, a first side, a second side opposite said first side and third and fourth side sides extending between said first and second sides;

a lid on said first side pivotal about an axis that extends parallel to said first through fourth sides and perpendicular to said bottom and said upper surface, said lid being pivotal between a first position in which an opening is formed in said first side and a second position at which the opening is closed;

caster attachment structure on said bottom of said suitcase body;

four pivotal casters respectively mounted at said four corners of said bottom, said four casters being free casters that are freely pivotal about respective axes parallel to said first through fourth sides of said suitcase body so as to be capable of freely running in all directions, and said four casters being mounted on said caster attachment structure, wherein said caster attachment structure comprises an attachment plate on said bottom of said suitcase body;

a handle mounted to said suitcase body so as to be upwardly extendible from said upper surface of said suitcase body, said handle having a U-shape and comprising two vertical rod members and a horizontal gripping part fixed to upper ends of said two vertical rod members, and said handle being disposed in a position such that said two vertical rod members extend from points that are adjacent to said third and fourth sides, respectively, and halfway between said first and second sides, and said horizontal gripping part extending in the longitudinal direction of said upper surface, wherein said handle is movable from a retracted position in which said horizontal gripping part is adjacent to and substantially parallel with said upper surface to an extended position in which said horizontal gripping part is vertically distant from but substantially parallel with said upper surface;

guides fixed to the center of said third and fourth side faces, extending vertically in said suitcase body, and slidably receiving said two vertical rod members, respectively; and a stopper engaging and stopping the handle from vertically moving at said retracted position and at said extended position;

wherein when said handle is in said retracted position and said stopper engages said handle in said retracted position a gripping space is defined between said gripping part and said upper surface of said suitcase body, whereby a user can carry said suitcase with said handle in said retracted position by putting the hand into said gripping space and gripping said gripping part of said handle.

2. The suitcase of claim 1, wherein a middle portion of said gripping part curves upwardly so as to define said gripping space in said retracted position.

3. The suitcase of claim 1, wherein said suitcase has outer dimensions smaller than 50 cm by 35 cm by 20 cm.

4. The suitcase of claim 1, wherein said suitcase body has a thickness greater than 10 cm and a width more than 20 cm.

5. The suitcase of claim 1, wherein said bottom face has a width in the range of 20 cm to 40 cm, said bottom face has a length in the range of 1.5 to 3 times the width thereof, and said suitcases has a height in the range of 40 cm to 60 cm.

6. The suitcase of claim 1, wherein said guides are cylindrical and said vertical rod members are cylindrical so as to have a shape corresponding to said guides, said guides being fixed to inner surfaces of said third and fourth side faces.

7. The suitcase of claim 1, wherein said stopper comprises an engagement pin resiliently biased toward one of said two vertical rod members and the one of said two vertical rod members comprises a recess for receiving said engagement pin.

8. The suitcase of claim 7, wherein said engagement pin is slidably mounted in a cylinder for movement between a projected position in which said engagement pin protrudes from a head of said cylinder and a retracted position, a piston in said cylinder that is connected to said engagement pin by a spring, and a knob that projects rearwardly from said cylinder and is connected with said piston, whereby when said knob is pulled rearwardly, said engagement pin is retracted by said piston and said spring so as to release said handle for movement.

9. The suitcase of claim 8, wherein said handle comprises a deep recess at a lower position on one of said two vertical rod members engageable by said engagement pin to prevent vertical movement of said handle upon application of a vertical force to said handle unless said engagement pin is retracted.

10. The suitcase of claim 7, wherein said two vertical rod members have a length such that when said handle is in said extended position the height from a lower end of one of said casters to said gripping part of said handle is 60 cm to 100 cm.

11. The suitcase of claim 10, wherein said two vertical rod members have a length such that when said handle is in said extended position the height from a lower end of one of said casters to said gripping part of said handle is about 80 cm.

12. The suitcase of claim 1, wherein said stopper comprises a ball resiliently biased toward one of said two vertical rod members and the one of said two vertical rod members comprises a recess for receiving said ball.

13. The suitcase of claim 1, wherein said four pivotal casters are fixed to said caster attachment plate.

14. The suitcase of claim 13, wherein said caster attachment Plate is fixed to said suitcase body with a reinforcing and space forming plate inserted between said caster attachment plate and said bottom of said suitcase body and said reinforcing and space forming plate comprises plywood reinforcing said bottom.

15. The suitcase of claim 13, wherein said caster attachment plate is fixed to said suitcase body with a reinforcing and space forming plate inserted between said caster attachment plate and said bottom of said suitcase body and said reinforcing and space forming plate comprises an aluminum plate.

* * * * *